United States Patent [19]

Eberhardt

[11] 3,950,922

[45] Apr. 20, 1976

[54] SEALING HEAD

[76] Inventor: Heinrich Eberhardt, Konigsberger Allee 56, Itzehoe, Germany, 221

[22] Filed: Dec. 4, 1974

[21] Appl. No.: 529,530

[30] Foreign Application Priority Data

Dec. 7, 1973 Germany ..... 2361067
Nov. 15, 1974 Germany ..... 2454200

[52] U.S. Cl. ..... 53/356; 53/360; 53/368

[51] Int. Cl.[2] ..... B65B 7/28; B67B 3/02

[58] Field of Search ..... 53/341, 344, 345, 346, 53/356, 351, 353, 359, 42, 360, 367, 368, 331, 362

[56] References Cited

UNITED STATES PATENTS

| | | | |
|---|---|---|---|
| 1,873,113 | 8/1932 | Darling | 53/344 |
| 2,541,601 | 2/1951 | Nelson | 53/368 |
| 2,670,118 | 2/1954 | Young | 53/351 |
| 3,122,868 | 3/1964 | Nofer et al. | 53/356 X |
| 3,427,786 | 2/1969 | Nofer | 53/356 |
| 3,585,787 | 6/1971 | Podesta | 53/344 |
| 3,672,121 | 6/1972 | Kawaminani | 53/351 |

*Primary Examiner*—Travis S. McGehee
*Assistant Examiner*—Horace M. Culver
*Attorney, Agent, or Firm*—McGlew and Tuttle

[57] ABSTRACT

In a sealing head for vacuum sealing a cap-shaped cover of relatively soft inelastic permanently deformable material with a sealing insert to a container of at least substantially rigid material provided with a beading on its outer face in the vicinity of its aperture, which sealing head has a flange plate, a head plate carrying a ring of pressure fingers projecting downwards and elastically yielding in a radial direction, which pressure fingers are surrounded by a rubber sleeve and also a steel sleeve placed over the latter, and a pressure plate carried by an axial shaft, held by the pressure fingers and displaceable inside these together with the shaft against the action of a spring, the improvement comprising the head plate together with the pressure fingers carried by it being displaceable relative to the flange plate by a limited amount on the shaft against the action of resilient means and enclosed by a rigid external shell connected to the flange plate and forming underneath the free end of the pressure fingers an opening for the cap-shaped covers which matches the external diameter thereof and the length of which corresponds substantially to the height of the covers.

7 Claims, 4 Drawing Figures

SEALING HEAD

Figure 1:
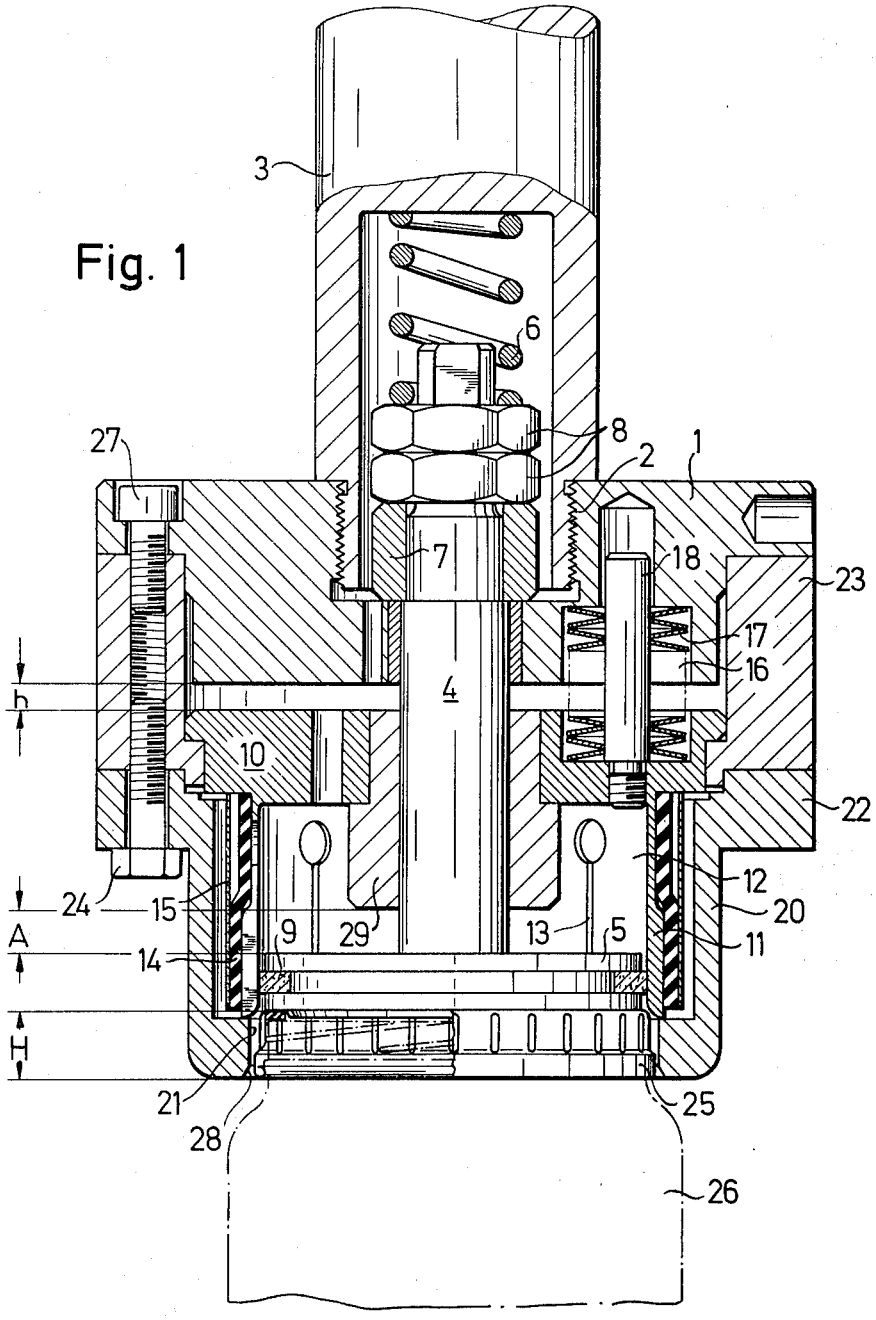

The invention relates to a sealing head for use in a sealing machine for attaching cap-shaped covers of relatively soft inelastic material and having sealing inserts to vacuum seal containers of at least substantially rigid material provided with beading and in particular thread beading on their outer faces in the vicinity of their necks, which sealing head has a flange plate, a head plate carrying a ring of pressure fingers projecting downwards and elastically yielding in a radial direction, which are surrounded by a rubber sleeve and also a steel sleeve placed over the latter, and a pressure plate carried by an axial shaft, held by the pressure fingers and displaceable inside these together with the shaft against the action of a spring.

Such sealing heads are already known (cf. German Published Specification No. 1,280,076, U.S. Pat. No. 3,122,868, G.B. Pat. No. 945,335).

In the last decade the techniques used in the production of vacuum closures for jars with large apertures have been developed with the creation of covers which make it possible, when desired, to manufacture a screw thread on the covers simultaneously with the production of the vacuum closure on containers provided with thread beadings. In the case of a known standard model for such covers, which is known by the term "uni-seal" in specialist circles (cf. German Registered Design No. 1,840,808, U.S. Pat. No. 3,123,241), the cylindrical side wall of the cover has a ring of indentations in the form of axial inwardly projecting ribs. The internal diameter of the covers is such that they fit over the beading, particularly the thread beading, of the neck of the container without deformation and the ribs cross over the beading. On attaching the cover to the container by means of a radially elasticially yielding sealing head, which is achieved through concentric reduction of the diameter of the side wall of the cover, the ribs are deformed locally where their ridges meet the ridges of the beading on the container. Therefore if the cover has thread beading, this operation will produce a continuous female thread in the cover. The use of such covers for jars has spread rapidly since it has been shown that vacuum seals produced in this way are very reliable and hardly any failures occur in manufacture.

In view of the very large unit numbers of containers filled ready for closure with such and similar covers, efforts are constantly being made to increase the working speed of the sealing machines. An object of the invention is to improve a sealing head of the kind referred-to above with the aim of making possible a further increase in the working speed of the sealing machines in which this sealing head is used without involving risk of operating troubles due to failures.

When using existing sealing heads the working speed of the sealing machines is restricted in that as a rule the containers, which are mostly of glass for industrial packaging, are not completely standard. Their rims have among other things divergence from an exactly circular shape and their height may differ — by as much as 2 mm. In practice such differences in form and size can hardly be avoided with these containers. For these reasons it is not possible to increase the working speed, i.e. the stroke rate of the machines and the sealing head, and the frequency of strokes per unit time at will if troubles due to breakage of the container material are to be avoided. Such troubles could be caused with known sealing heads, particularly when working rapidly, in that with inexact centering of the container with the cover loosely lying thereon underneath the ring of pressure fingers, individual pressure fingers could strike hard with their front edge against the rim of the base of the cover and the underlying part of the container wall during the down stroke. This danger is even greater when the internal diameter of the ring of pressure fingers was somewhat less than the external diameter of the cover. Similar troubles could be caused in that towards the end of the closing operation a sharp blow could be delivered through the pressure plate to a container which is slightly too tall due to the immovable nature of the stop limiting the working travel of the pressure plate inside the sealing head. Naturally in the known sealing heads the pressure fingers are already rounded at the edge introducing the cover. But this is not sufficient for self-centering at high working speeds due to the internal diameter of the ring of pressure fingers being smallish in relation to the external diameter of the cover. Indeed the pressure plate in known sealing heads could also run on upwards over a distance determined by its normal working travel. However the head plate or the part of the sealing head forming the upper limit for the travel of the pressure plate is rigidly connected with the flange plate of the sealing head, which involves the danger of breakage at the end of the closing operation even with a glass container slightly above normal height.

In accordance with the invention the problem of creating the conditions for further increase in the working speed without the risk of breakage, overcoming or mitigating the difficulties mentioned above, is resolved in that the head plate together with pressure fingers carried by it is displaceable relative to the flange plate by a limited amount on the shaft against the force of resilient means and encased by a rigid external shell connected to the flange plate and forming under the free end of the pressure fingers an opening matching the external diameter of the cap-shaped cover for introduction of the cover, the length of which corresponds substantially to the height of the cover.

In this way as a result of the matching of the cover-introducing opening to the external diameter of the undeformed cover, centering is facilitated before commencing the closing operation and at the same time the inevitable small differences in the height of the containers to be sealed are rendered harmless.

Figure 2A:
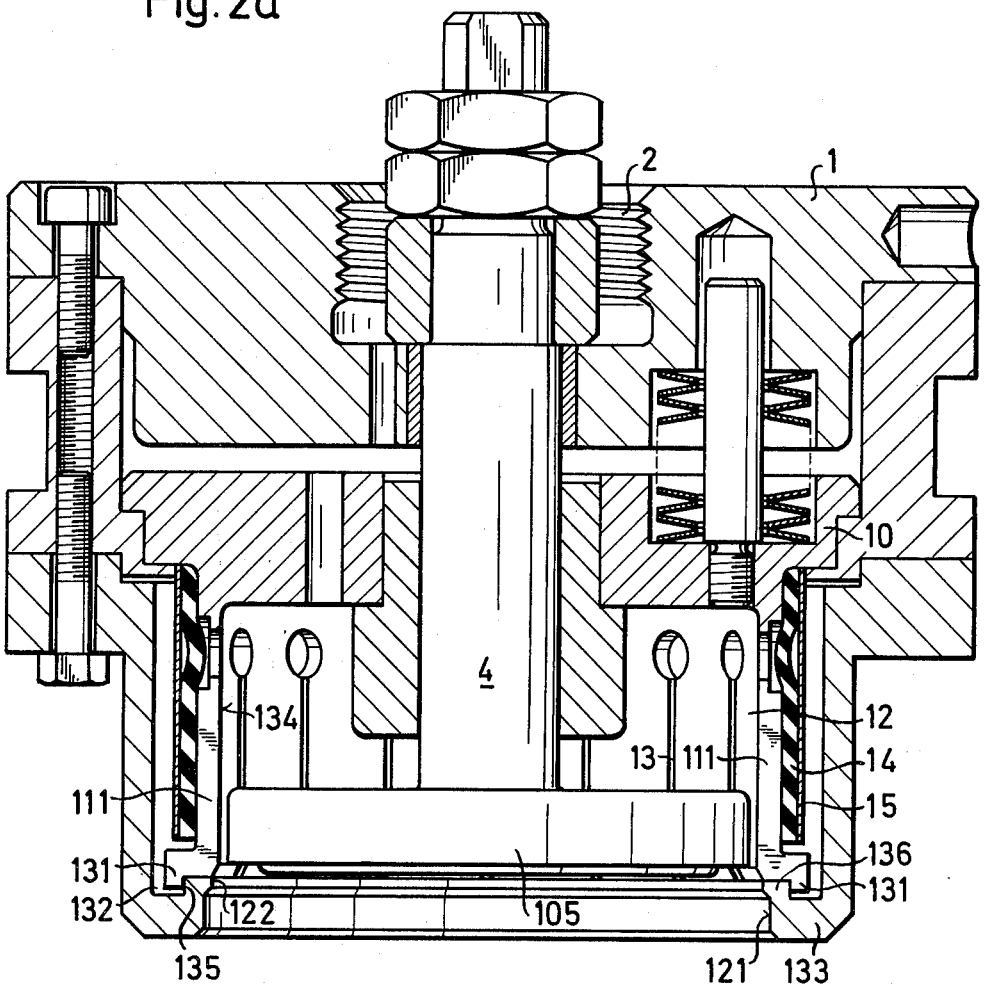
Figure 2B:
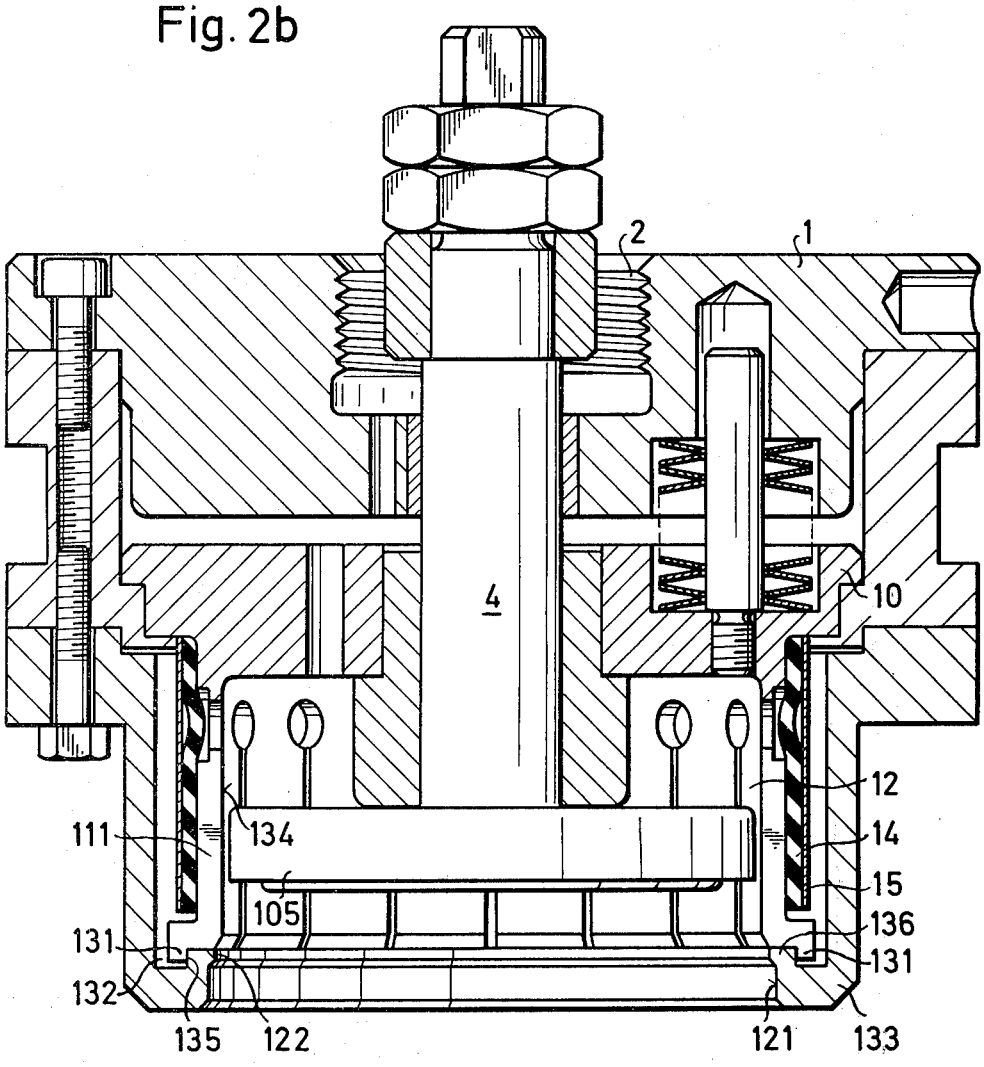
Figure 3:
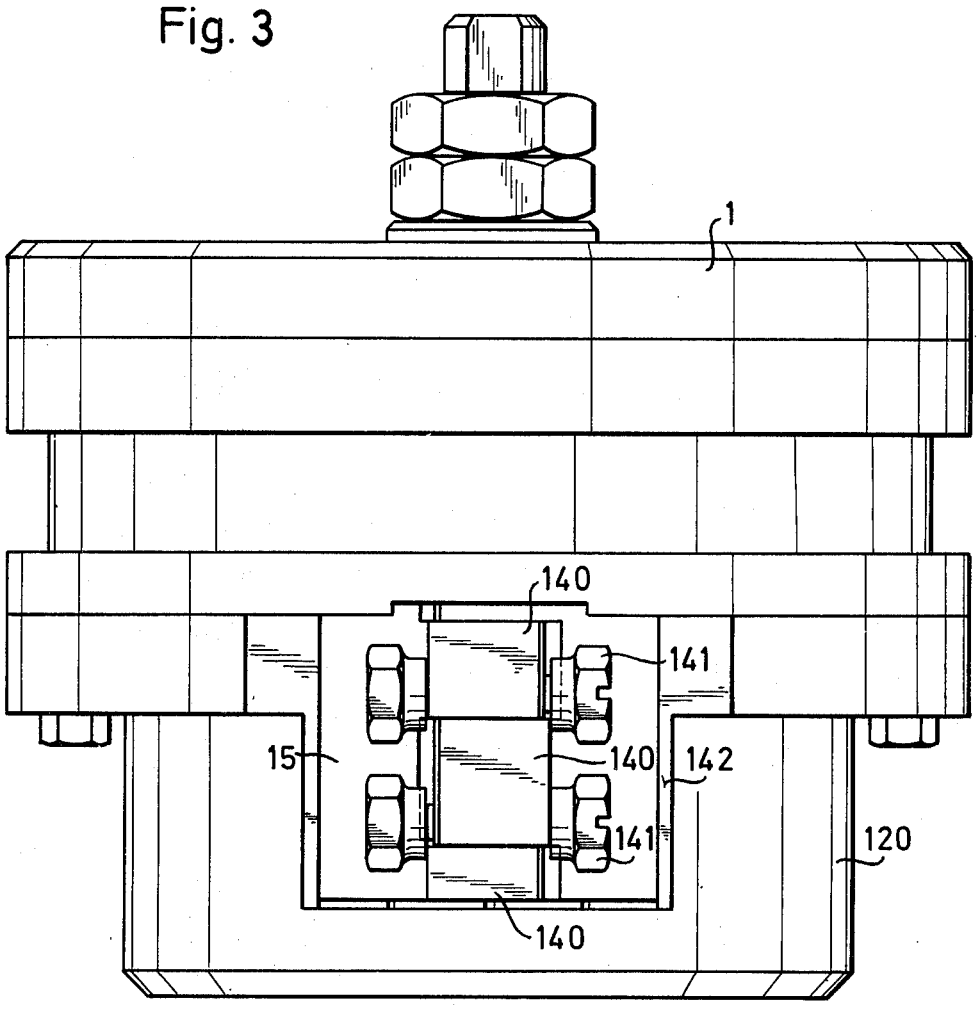

The invention is diagrammatically illustrated, by way of example, with reference to the accompanying drawing, in which:

FIG. 1 shows an axial section through an embodiment of a sealing head in conjunction with a cover depicted half in section, introduced into the introduction opening of the external shell of the sealing head and already centered by it, and lying loosely on a container;

FIGS. 2*a* and 2*b* show a further embodiment, similarly in axial section, in two positions, and FIG. 3 shows a truncated elevation of a detail thereof.

In the drawing reference 1 denotes a flange plate carrying a sealing head as a whole. It is provided with a recessed central bore having a thread 2 and bolted onto a supporting part 3 which is tubular in shape and forms part of the sealing machine. The flange plate is traversed by a displaceable shaft 4 which carries a pressure plate 5 at its lower end. The shaft with the pressure plate is under the action of a coil spring 6 which seeks to press the shaft and pressure plate downwards. Reference 7 denotes a spacer which bears on the one hand against the flange plate 1 and on the other against a stop formed by locknuts 8 on the shaft. A head plate 10 carries a ring of pressure fingers 11 projecting downwards and elastically yielding in the radial direction. The pressure fingers are formed by parts of a thin-walled hollow cylinder 12 connected with the head plate 10 and are separated from one another by recesses 13 open at the bottom along generatrices of the hollow cylinder 12. The pressure fingers 11 are enclosed in common by a rubber sleeve 14 and a steel sleeve 15 placed over the latter. The pressure plate 5 is held by the pressure fingers. Between the two there is a felt ring 9 in a groove on the circumference of the pressure plate.

The head plate 10 is displaceable by a limited amount together with the pressure fingers 11 carried by it relative to the flange plate 1 on the shaft 4 against the force of spring devices 16 which are more powerful than the spring 6. The spring devices 16, of which only one is shown here, but a plurality of which, e.g. three, may be disposed on the circumference of the head, each consist of a stack of cup springs 17 with a guide pin 18.

The head plate 10 together with the pressure fingers 11 is enclosed by a rigid external shell 20 connected to the flange plate 1. Under the free ends of the pressure fingers 11 this shell forms an opening 21 matching the external diameter of cap-shaped covers for introduction of the covers and the length of which roughly corresponds to the height of the covers 25. In the drawing one such cover is shown which is loosely placed on a container 26 and located in a position directly before the commencement of the closing operation. In this position it is held and centered by the opening of the external shell for introduction of the cover and touches the underside of the pressure plate 5. Now if the sealing head descends any further, the closing operation begins. In this the elastically yielding pressure fingers 11 grasp the cover 25 and press concentrically on its side walls so that the cover is made narrower.

The external shell 20 is formed of a plurality of annular elements 22, 23 detachably connected with one another, which are secured to one another by bolts 24 and to the flange plate 1 by bolts 27. This has the advantage that the part 22 of the external shell can be changed easily and, when the sealing head is used in conjunction with covers of other dimensions, replaced with a corresponding element matching these. The introduction opening 21 has the form of a straight circular cylinder and has a bevelled or rounded face 28 at the edge of its mouth to facilitate introduction of the cover.

For centering, the cover-introduction opening 21 should correspond to the diameter of the undeformed cover and the distance H between pressure plate and lower edge of the external shell to the height of the type of cover. The latter can be matched by selection of the part 22 of the external shell to the height of the cover.

The distance A between the pressure plate 5 and the bush 29 inserted into the head plate 10 determines the working travel of the shaft or the sealing depth. This should be precisely limited and always the same, regardless of the slightly differing heights of the individual containers. If at the end of the closing operation the top of the pressure plate 5 strikes against the underside of the bush 29 normally restricting the working travel, this bush can yield further over the height tolerance *h* by lifting the head plate 10 against the spring devices 16 in the event that the height of the container 26 is too great in individual cases, which may be the case up to about 2 mm. Thus the dimension *h* should be greater than 2 mm.

In principle it is possible to employ a sealing head in accordance with the invention in conjunction with many embodiments of covers other than those described in connection with the example.

FIGS. 2*a* and 2*b* show an embodiment with further improvements.

A flange plate 1 of a sealing head which is provided with a recessed central bore, the extended upper section of thread 2 of which serves for bolting onto a tubular supporting part not shown here, which contains a powerful compression spring which urges the shaft 4 with the pressure plate 105 downwards. A head plate 10, carries a ring of pressure fingers 111 projecting downwards and elastically yielding in the radial direction. The pressure fingers are formed by parts of a thin-walled hollow cylinder 12 connected to the head plate 10 and are separated from one another by recesses 13 open at the bottom along generatrices of the hollow cylinder 12. The pressure fingers are enclosed in common by a rubber sleeve 14 and a steel sleeve 15 placed over the latter. The pressure plate 105, which in this embodiment has a smooth cylindrical external casing, is held by the pressure fingers. The steel sleeve 15 consists of an open steel band curved into a circle with radially bent ends which are reinforced with plates or blocks 140 and can be drawn against one another by clamping screws 141. This clamping device is accessible from outside through a window-like aperture 142 in the external shell 120.

As FIG. 2 shows, a flange 133 projecting inwards and forming the opening 121 for introduction of the cover is provided at the lower end of the rigid external shell 120. A circular projection 136 extends upwards from this flange. The free ends of the elastic pressure fingers 111 have an extension 131 which engages in the circular groove 132 behind the circular projection 136 so that the ability of the pressure fingers to move radially inwards is restricted. The inner wall 134 of the pressure fingers 111 projecting radially inwards over the wall of the cover-introduction opening 121 of the external shell 120 forms in the area of the extension 131 a step 135 with resilience in a radial outward direction which serves to receive the circular projection 136.

In this way effective restriction of the internal chamber of the hollow cylinder 12 inside the pressure fingers 111 to a predetermined diameter which is somewhat less than the diameter of the cover-introduction opening 121 is achieved. For even better centering the cover-introduction opening 121 has in its upper part a further constriction 122, the diameter of which lies between the diameter of the opening 121 and that of the hollow cylinder 12 constituted by the pressure fingers 111.

Through adjustment of the steel sleeve 15 by means of the clamping screws 141, the amount by which the ring of pressure fingers 111 yields in an outward radial direction can be limited. At the same time in this way the ability of the pressure fingers to move in the inward direction can be restricted by the circular projection 136 so that the elastic rubber sleeve 14 is held preloaded. Through the preloading of the rubber sleeve, greater accuracy is ensured in the closing operation when securing a cover to a container, and particularly uniform localised pressure of the beading at the ribs in the case of covers made of a soft inelastic and thus unrestorable sheet material with axial ribs which are pressed radially against thread beading on the outside of the container during the closing operation.

I claim:

1. A sealing head for applying a cover having an exterior substantially cylindrical skirt to a container, comprising a support adapted to move vertically, a flange plate secured to said support adjacent the lower end thereof, a rigid substantially cylindrical external shell connected to said flange plate and having a lower shell flange portion with a bottom opening of a size to accommodate the cover therein, a head plate movable between said shell flange portion and said flange plate, a shaft portion extending through said flange plate and terminating in a press plate portion within said shell below said head plate and engageable with the cover to press it onto the container, spring means biasing said head plate toward engagement with said cylindrical shell, said head plate having a ring of a plurality of circumferentially arranged and downwardly extending resilient yieldable pressure fingers located within said shell and biased against said pressure plate portion, a rubber sleeve engaged over said fingers, a substantially cylindrical steel sleeve engaged over said fingers, said shaft portion and said pressure plate being displaceable upwardly and downwardly in respect to said yieldable fingers between the lower end of said lower flange portion and said head plate and being further displaceable with said head plate upwardly against said biasing means.

2. A sealing head as claimed in claim 1, wherein the rigid external shell is composed of a plurality of annular elements detachably connected to one another.

3. A sealing head as claimed in claim 1, wherein the opening in the external shell for the covers has the form of a straight circular cylinder corresponding to the external diameter of the undeformed cover and has a bevelled edge on the rim of its mouth.

4. A sealing head as claimed in claim 1, wherein the distance of the lower edge of the external shell from the pressure plate can be matched to the height of the cover by changing a part of the external shell.

5. A sealing head as claimed in claim 1, wherein said flange portion is provided at the lower end of said rigid external shell, which flange projects inwards to form the opening for introduction of the cover and from which a circular projection extends upwards, and wherein said elastic pressure fingers have free ends and said free ends each have an extension which engages behind the circular projection so that the ability of the pressure fingers to move radially inwards is restricted.

6. A sealing head as claimed in claim 5, wherein each of the elastic pressure fingers has an internal wall, and wherein said internal walls extend inwards over a wall of the opening in the rigid external shell for introduction of the cover to form in the area of their extension a step with resilience in a radial outward direction which serves to receive the circular projection.

7. A sealing head according to claim 1, including a coil spring engaged against said shaft and biasing it in a downward direction toward the container and including a plurality of segmental partial annular elements disposed between said flange plate and said flange portion of said shell and threaded bolt means extending between said flange plate and said flange portion of said shell between said annular elements to hold said elements to said flange plate and to said shell.

* * * * *